US009537201B2

(12) United States Patent
Alexopoulos et al.

(10) Patent No.: US 9,537,201 B2
(45) Date of Patent: Jan. 3, 2017

(54) RECONFIGURABLE ANTENNA STRUCTURE WITH RECONFIGURABLE ANTENNAS AND APPLICATIONS THEREOF

(71) Applicant: BROADCOM CORPORATION, Irvine, CA (US)

(72) Inventors: Nicolaos Georgiou Alexopoulos, Irvine, CA (US); Seunghwan Yoon, Irvine, CA (US); Alfred Grau Besoli, Barcelona (ES)

(73) Assignee: BROADCOM CORPORATION, Irvine, CA (US)

( * ) Notice: Subject to any disclaimer, the term of this patent is extended or adjusted under 35 U.S.C. 154(b) by 569 days.

(21) Appl. No.: 14/042,541

(22) Filed: Sep. 30, 2013

(65) Prior Publication Data

US 2015/0070216 A1 Mar. 12, 2015

Related U.S. Application Data

(60) Provisional application No. 61/876,528, filed on Sep. 11, 2013.

(51) Int. Cl.

| | |
|---|---|
| ***H01Q 3/00*** | (2006.01) |
| ***H01Q 1/36*** | (2006.01) |
| ***H01Q 3/24*** | (2006.01) |
| ***H01Q 9/14*** | (2006.01) |
| ***H01Q 9/27*** | (2006.01) |
| ***H01Q 21/28*** | (2006.01) |

(52) U.S. Cl.

CPC ..... *H01Q 1/36* (2013.01); *H01Q 3/247* (2013.01); *H01Q 9/14* (2013.01); *H01Q 9/27* (2013.01); *H01Q 21/28* (2013.01)

(58) Field of Classification Search

CPC ..... H01Q 3/00; H01Q 3/247; H01Q 1/36; H01Q 9/14; H01Q 9/27; H01Q 21/28

USPC ..... 342/368

See application file for complete search history.

(56) References Cited

U.S. PATENT DOCUMENTS

| | | | | |
|---|---|---|---|---|
| 4,243,993 A * | 1/1981 | Lamberty | ..... | H01Q 11/083 343/895 |
| 4,605,934 A * | 8/1986 | Andrews | ..... | H01Q 25/001 343/895 |
| 5,313,216 A * | 5/1994 | Wang | ..... | H01Q 9/27 343/700 MS |
| 6,023,250 A * | 2/2000 | Cronyn | ..... | H01Q 1/36 343/895 |

(Continued)

*Primary Examiner* — Harry Liu

(74) *Attorney, Agent, or Firm* — Garlick & Markison; Bruce E. Garlick

(57) ABSTRACT

A reconfigurable antenna structure includes first and second reconfigurable antennas, a configuration module, and an antenna processing circuit. The first reconfigurable antenna is configured, in response to a first configuration signal, to have a first radiation pattern and to have a first frequency bandwidth and the second reconfigurable antenna is configured, in response to a second configuration signal, to have a second radiation pattern and to have a second frequency bandwidth. The configuration module is configured to generate the first and second configuration signals. The antenna processing circuit is configured to send one or more transmit signals to one or more of the first and second reconfigurable antennas for transmission via one or more of the channels of interest and receive one or more receive signals from the one or more of the first and second reconfigurable antennas.

20 Claims, 8 Drawing Sheets

(56) References Cited

U.S. PATENT DOCUMENTS

| | | | | |
|---|---|---|---|---|
| 6,452,568 | B1 * | 9/2002 | Zidek | H01Q 1/36 343/700 MS |
| 6,859,181 | B2 * | 2/2005 | Colburn | H01Q 1/3275 343/713 |
| 6,906,682 | B2 * | 6/2005 | Alexopoulos | H01P 1/2005 343/895 |
| 6,947,010 | B2 * | 9/2005 | Alexopoulos | H01Q 1/241 343/876 |

* cited by examiner

RECONFIGURABLE ANTENNA STRUCTURE WITH RECONFIGURABLE ANTENNAS AND APPLICATIONS THEREOF

CROSS REFERENCE TO RELATED PATENTS

The present U.S. Utility Patent Application claims priority pursuant to 35 U.S.C. §119(e) to the following U.S. Provisional Patent Application which is hereby incorporated herein by reference in its entirety and made part of the present U.S. Utility Patent Application for all purposes:

U.S. Provisional Application Ser. No. 61/876,528, entitled "CONFIGURABLE ANTENNA STRUCTURE WITH CONFIGURABLE ANTENNAS AND APPLICATIONS THEREOF," filed Sep. 11, 2013.

STATEMENT REGARDING FEDERALLY SPONSORED RESEARCH OR DEVELOPMENT

NOT APPLICABLE

INCORPORATION-BY-REFERENCE OF MATERIAL SUBMITTED ON A COMPACT DISC

NOT APPLICABLE

BACKGROUND

Technical Field

This invention relates generally to wireless communication systems and more particularly to antenna structures used in such wireless communication systems.

Description of Related Art

Communication systems are known to support wireless and wire lined communications between wireless and/or wire lined communication devices. Such communication systems range from national and/or international cellular telephone systems to the Internet to point-to-point in-home wireless networks to radio frequency identification (RFID) systems to radio frequency radar systems. Each type of communication system is constructed, and hence operates, in accordance with one or more communication standards. For instance, radio frequency (RF) wireless communication systems may operate in accordance with one or more standards including, but not limited to, RFID, IEEE 802.11, Bluetooth, global system for mobile communications (GSM), code division multiple access (CDMA), WCDMA, local multi-point distribution systems (LMDS), multi-channel-multi-point distribution systems (MMDS), LTE, WiMAX, and/or variations thereof. As another example, infrared (IR) communication systems may operate in accordance with one or more standards including, but not limited to, IrDA (Infrared Data Association).

For an RF wireless communication device to participate in wireless communications, it includes a built-in radio transceiver (i.e., receiver and transmitter) or is coupled to an associated radio transceiver (e.g., a station for in-home and/or in-building wireless communication networks, RF modem, etc.). The receiver is coupled to the antenna and includes a low noise amplifier, one or more intermediate frequency stages, a filtering stage, and a data recovery stage. The transmitter includes a data modulation stage, one or more intermediate frequency stages, and a power amplifier, which is coupled to the antenna.

Since a wireless communication begins and ends with the antenna, a properly designed antenna structure is an important component of wireless communication devices. As is known, the antenna structure is designed to have a desired impedance (e.g., 50 Ohms) at an operating frequency, a desired bandwidth centered at the desired operating frequency, and a desired length (e.g., ¼ wavelength of the operating frequency for a monopole antenna). As is further known, the antenna structure may include a single monopole or dipole antenna, a diversity antenna structure, an antenna array having the same polarization, an antenna array having different polarization, and/or any number of other electromagnetic properties.

Two-dimensional antennas are known to include a meandering pattern or a micro strip configuration. For efficient antenna operation, the length of an antenna should be ¼ wavelength for a monopole antenna and ½ wavelength for a dipole antenna, where the wavelength ($\lambda$)=c/f, where c is the speed of light and f is frequency. For example, a ¼ wavelength antenna at 900 MHz has a total length of approximately 8.3 centimeters (i.e., $0.25*(3\times10^8$ m/s)/($900\times10^6$ c/s)=0.25*33 cm, where m/s is meters per second and c/s is cycles per second). As another example, a ¼ wavelength antenna at 2400 MHz has a total length of approximately 3.1 cm (i.e., $0.25*(3\times10^8$ m/s)/($2.4\times10^9$ c/s)=0.25*12.5 cm).

While two-dimensional antennas provide reasonable antenna performance for many wireless communication devices, there are issues when the wireless communication devices require full duplex operation and/or multiple input and/or multiple output (e.g., single input multiple output, multiple input multiple output, multiple input single output) operation. For instance, antenna arrays and other antenna structures use antennas with the same radiation pattern and bandwidth.

BRIEF DESCRIPTION OF THE SEVERAL VIEWS OF THE DRAWING(S)

DETAILED DESCRIPTION

Figure 1:
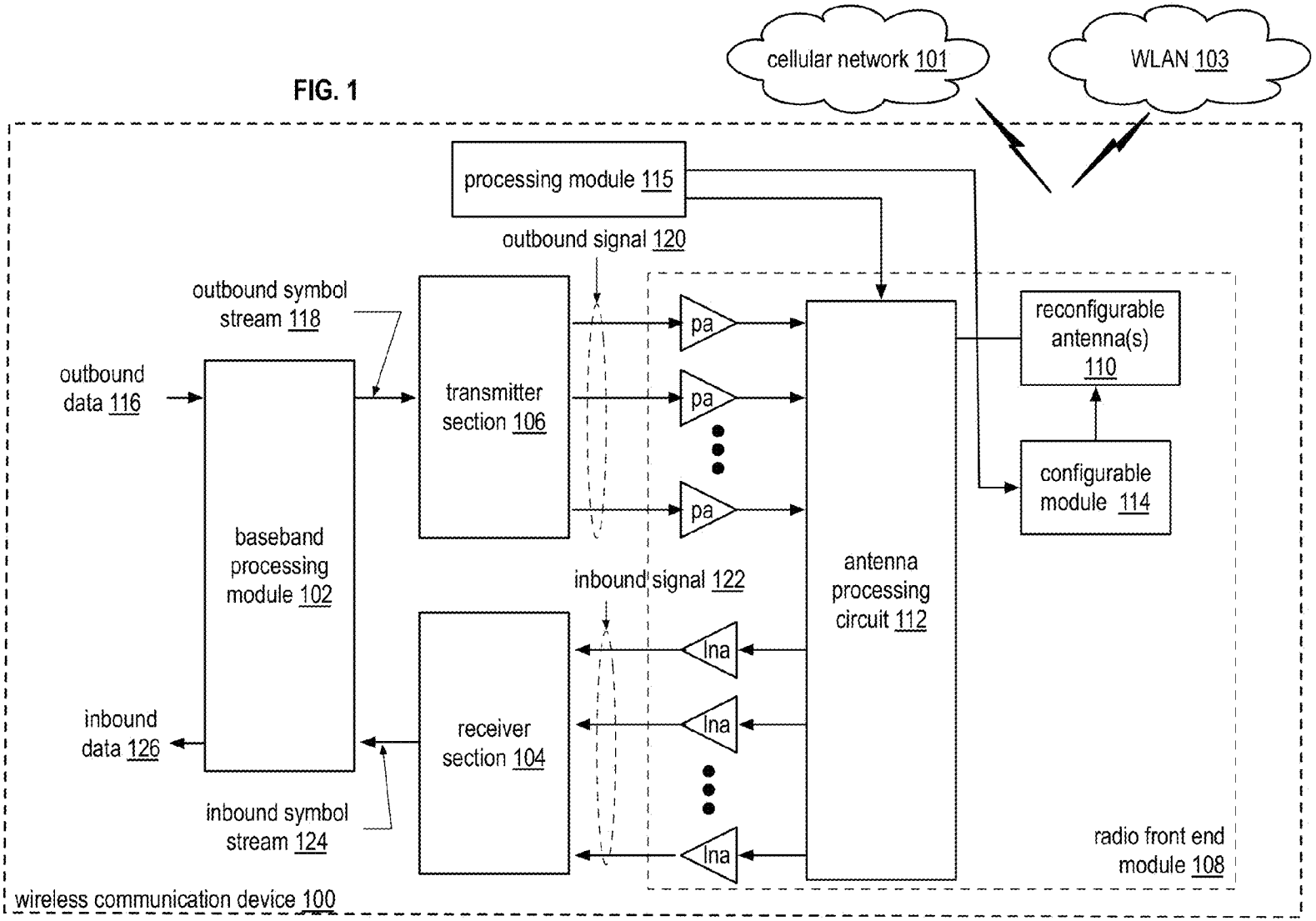
FIG. 1 is a schematic block diagram of an embodiment of a wireless communication device in accordance with the present disclosure.

FIG. 1 is a schematic block diagram of an embodiment of a wireless communication device 100 that may be any device that can be carried by a person, can be at least partially powered by a battery, includes a radio transceiver (e.g., radio frequency (RF) and/or millimeter wave (MMW)) and performs one or more software applications. For example, the wireless communication device 100 may be a cellular telephone, a laptop computer, a personal digital assistant, a video game console, a video game player, a personal entertainment unit, a tablet computer, etc. The wireless communication device 100 may communicate via the cellular network 101 and/or the wireless local area network (WLAN) network 103 in accordance with one or more cellular and/or WLAN protocols.

The wireless communication device 100 includes a baseband processing module 102, a receiver section 104, a plurality of low noise amplifiers, a transmitter section 106, a plurality of power amplifiers, a processing module 115, and radio front-end module 108. The radio front-end module 108 includes power amplifiers (pa), low noise amplifiers (lna), a reconfigurable antenna array 110, an antenna processing circuit 112, and a configuration module 114. The reconfigurable antenna array 110 includes reconfigurable antennas, each of which has a different radiation pattern and a frequency bandwidth, which collectively form a radiation pattern and frequency bandwidth for a reconfigurable antenna array 110.

In an example of transmitting an outbound signal 120, the baseband processing module 102 converts outbound data 116 (e.g., voice, text, audio, video, graphics, etc.) into one or more outbound symbol streams 118 in accordance with one or more wireless communication standards (e.g., GSM, CDMA, WCDMA, HSUPA, HSDPA, WiMAX, EDGE, GPRS, IEEE 802.11, Bluetooth, ZigBee, universal mobile telecommunications system (UMTS), long term evolution (LTE), IEEE 802.16, evolution data optimized (EV-DO), etc.). Such a conversion includes one or more of: scrambling, puncturing, encoding, interleaving, constellation mapping, modulation, frequency spreading, frequency hopping, beamforming, space-time-block encoding, space-frequency-block encoding, frequency to time domain conversion, and/or digital baseband to intermediate frequency conversion. Note that the baseband processing module 102 converts the outbound data 116 into a single outbound symbol stream 118 for Single Input Single Output (SISO) communications and/or for Multiple Input Single Output (MISO) communications and converts the outbound data 116 into multiple outbound symbol streams 118 for Single Input Multiple Output (SIMO) and Multiple Input Multiple Output (MIMO) communications.

The baseband processing module 102 provides the outbound symbol stream(s) 118 to an up conversion circuit of the transmit section 106, which converts the outbound symbol stream(s) 118 into one or more up converted signals (e.g., signals in one or more frequency bands 800 MHz, 1800 MHz, 1900 MHz, 2000 MHz, 2.4 GHz, 5 GHz, 60 GHz, etc.). The up conversion circuit may have a direct conversion topology or a super-heterodyne topology and may include discrete digital components and/or analog circuitry. In addition, the up conversion circuit may receive and process the outbound symbol stream(s) 118 as Cartesian coordinates, as polar coordinates, and/or as hybrid polar-Cartesian coordinates.

A transmit (TX) output circuit of the transmitter section 106 receives the one or more up converted signals and provides them to one or more of the power amplifiers (pa). The transmit output circuit may include a splitter for providing an up converted signal to multiple power amplifiers such that, when the signals are transmitted, they are combined in air, which increases the transmit power. In this manner, one or more of the expensive discrete components (e.g., surface acoustic wave (SAW) filters, off-chip power amplifiers, duplexers, inductors, and/or capacitors) may be omitted. In addition, or in the alternative, the transmit output circuit may include one or more phase shift circuits to phase shift the one or more up converted signals to facilitate beamforming. The transmit output circuit may further include, or include in the alternative, a polar coordinate drive to facilitate polar coordinate outbound signals.

Regardless of the specific implementation of the transmit output circuit, one or more power amplifiers receives the up-converted signal(s) and amplifies them to produce outbound signal(s) 120. The power amplifier(s) provide the outbound signal(s) 120 to the antenna processing circuit 112. The antenna processing circuit 112 provides components of the outbound signal to the reconfigurable antenna array 110 for transmission. For example, the components of the outbound signal may be created by the transmit output circuit or the antenna processing circuit may produce them from the outbound signal 120. Note that the reconfigurable antenna array 110 is configured in accordance with configuration signals from the configuration module 114.

In an example of receiving an inbound signal 122, the reconfigurable antenna array 110 receives respective components of the inbound signal 122 and provides them to the antenna processing circuit 112. The antenna processing circuit 112 provides the components of the inbound signal 122 to one or more low noise amplifiers via the transmit/receive isolation module 114.

The low noise amplifiers amplify the inbound signal components to produce amplified inbound signal(s). The low noise amplifier(s) provide the amplified inbound signal components to a receive (RX) input circuit of the receiver section 104, which is a complimentary circuit to the transmit output circuit of the transmitter section. For instance, if the transmit output circuit includes a splitter, the receive input circuit includes a combiner to combine the components into the inbound signal 122.

Alternatively, the antenna processing circuit 112 combines the components into one or more inbound signals 122 that are provided to one or more of the low noise amplifiers via one or more transmit/receive isolation modules 114. The low noise amplifier(s) amplifies the one or more inbound signals 122 and provides them to the receive input circuit of the receiver section 104.

The receive input circuit provides the inbound signal to a down conversion circuit of the receiver section, which converts the inbound signal into one or more inbound symbol streams 124. The down conversion circuit may have a direct conversion topology or a super-heterodyne topology and may include discrete digital components and/or analog circuitry. In addition, the down conversion circuit may receive and process the inbound signals as Cartesian coordinates, as polar coordinates, and/or as hybrid polar-Cartesian coordinates.

The baseband processing module 102 converts the inbound symbol stream(s) 124 into inbound data 126 (e.g., voice, text, audio, video, graphics, etc.) in accordance with one or more wireless communication standards. Such a conversion may include one or more of: digital intermediate frequency to baseband conversion, time to frequency domain conversion, space-time-block decoding, space-frequency-block decoding, demodulation, frequency spread decoding, frequency hopping decoding, beamforming decoding, constellation demapping, deinterleaving, decoding, depuncturing, and/or descrambling. Note that the baseband processing module 102 converts a single inbound symbol stream 124 into the inbound data 126 for Single Input Single Output (SISO) communications and/or for Multiple Input Single Output (MISO) communications and converts multiple inbound symbol streams 124 into the inbound data 126 for Single Input Multiple Output (SIMO) and Multiple Input Multiple Output (MIMO) communications.

The wireless communication device 100 may be implemented using one or more integrated circuits (IC) and one or more substrates (e.g., printed circuit boards), where an IC includes one or more IC dies and an IC package substrate. For example, the antenna processing circuit 112, the power amplifiers, and the low noise amplifiers may be implemented on the one or more IC dies and the reconfigurable antenna 110 on an IC package substrate and/or one of the substrates. As another example, one or more of the baseband processing module 102, the receiver section 104, the transmitter section 106, and the processing module 115 may also be implemented on the one or more IC dies.

Figure 2:
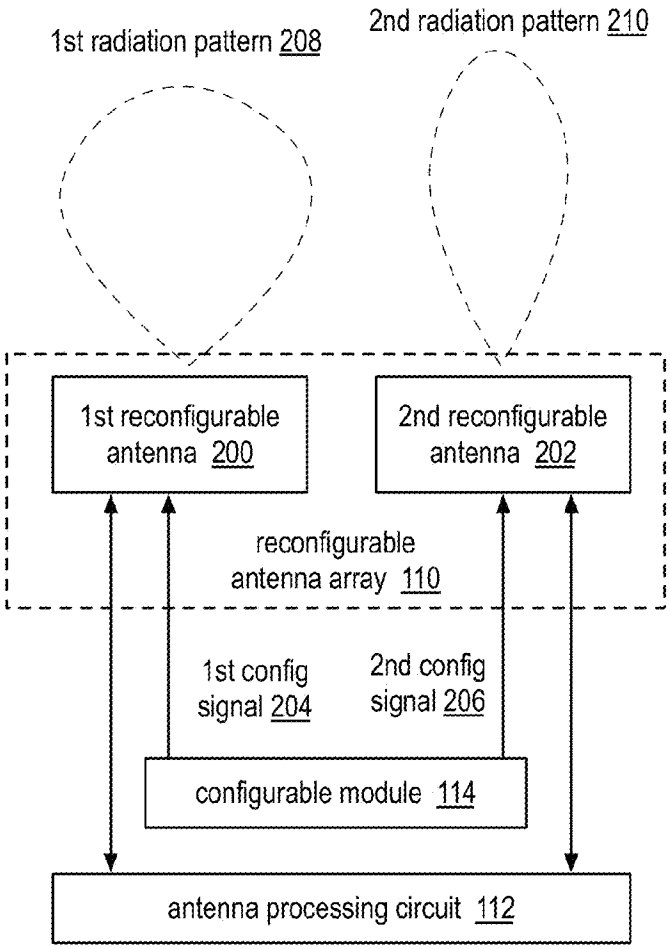
FIG. 2 is a schematic block diagram of an embodiment of a reconfigurable antenna structure in accordance with the present disclosure.

FIG. 2 is a schematic block diagram of an embodiment of a reconfigurable antenna structure that includes a reconfigurable antenna array 110, the configuration module 114, and the antenna processing circuit 112. The reconfigurable antenna array 110 includes first and second reconfigurable antennas 200 and 202. The first reconfigurable antenna 200 is configured to produce a first radiation pattern 208 and the second reconfigurable antenna 202 is configured to produce a second radiation pattern 210. The first reconfigurable antenna 200 and the second reconfigurable antenna 202 are configured such that the first and second radiation patterns 208-210 are different. Depending on the differences in the antennas' configurations, the radiation patterns can also differ in direction, polarization, etc.

As shown, the first reconfigurable antenna 200 has a shorter, wider radiation pattern than that of the second reconfigurable antenna 200. When the first reconfigurable antenna 200 and the second reconfigurable antenna 202 are used in the same antenna array, their respective radiation patterns combine in air to provide a broader, more diverse radiation pattern than achieved separately. Combining the first and second radiation patterns 208-210 creates a taller radiation pattern than achieved with the first reconfigurable antenna 200 alone and a wider radiation pattern than achieved by using the second reconfigurable antenna 202 alone therefore improving the diversity and capacity of the antenna array 110 in comparison to an antenna array that includes similarly shaped antennas.

Figure 3:
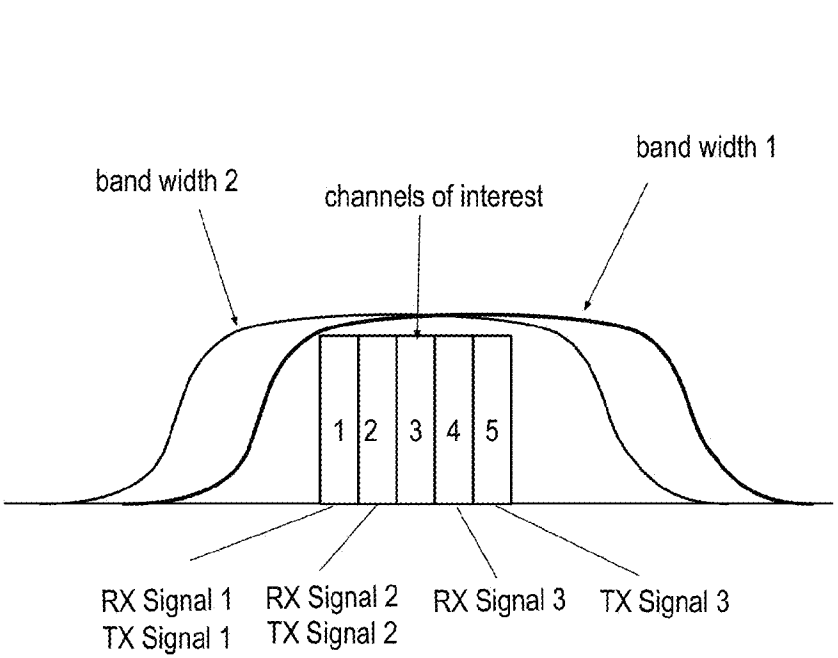
FIG. 3 is a diagram of examples of bandwidths of a reconfigurable antenna structure in accordance with the present disclosure.

FIG. 3 is a diagram of examples of bandwidths of a reconfigurable antenna structure. A first bandwidth (e.g., #1) of the first reconfigurable antenna 200 and a second bandwidth (e.g., #2) of the second reconfigurable antenna 202 substantially overlap channels of interest. If the first and second bandwidths differ, they have a substantial enough overlap to include channels of interest for proper operation. Channels of interest may be in one or more of a plurality of frequency bands, such as 850 MHz and 1900 MHz for cellular communication, 2.4 GHz, 3.6 GHz, 5 GHz, and 60 GHz for WLAN communications and/or personal area network communications. In general, the resonant frequencies of the first and second reconfigurable antennas 200-202 should be proximal to the center frequency of the channel of interest's frequency band, but may be offset from the center frequency to provide a more diverse antenna array.

In an example of operation, the antennas are configured to support three concurrent or time duplexed communications via the channels of interest. A first communication (RX and TX signal 1) is conveyed over a first channel, a second communication (RX and TX signal 2) is conveyed over a second channel, and a third communication has transmit signals (TX signal 3) conveyed over channel 5 and receive signals (RX signal 3) conveyed over channel 4. The communications may be separate communications and/or communications of a MIMO communication.

Figure 4:
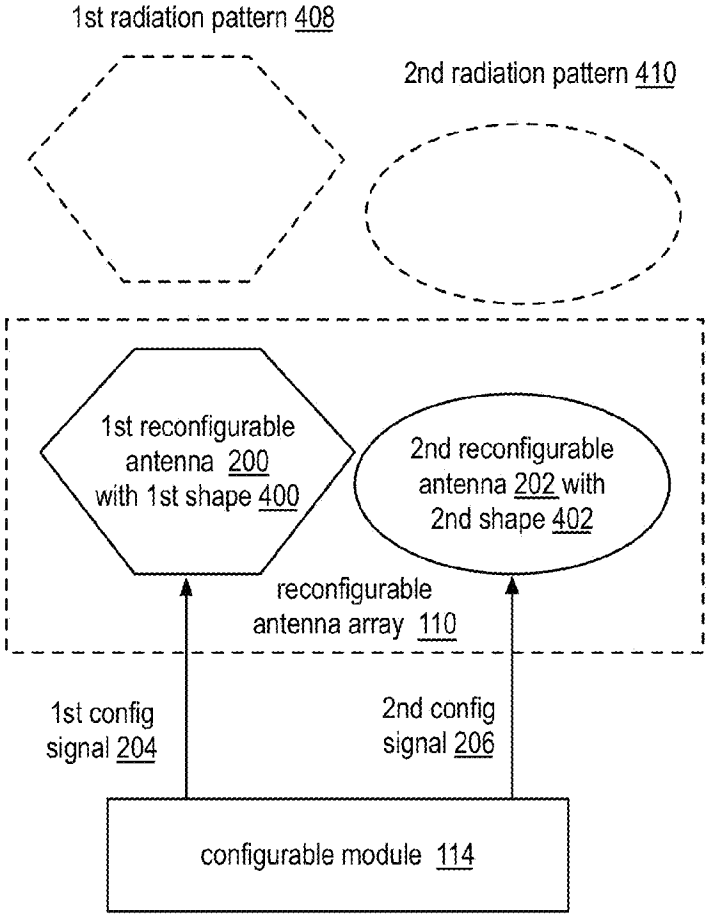
FIG. 4 is a schematic block diagram of another embodiment of a reconfigurable antenna structure in accordance with the present disclosure.

FIG. 4 is a schematic block diagram of another embodiment of a reconfigurable antenna structure that includes a reconfigurable antenna array 110, the configuration module 114, and the antenna processing circuit 112. The reconfigurable antenna array 110 includes first and second reconfigurable antennas 200 and 202. The first reconfigurable antenna 200 is configured to have a first geometric shape 400 that produces a first radiation pattern 408 and the second reconfigurable antenna 202 is configured to have a second geometric shape 402 that produces a second radiation pattern 410. The first reconfigurable antenna 200 and the second reconfigurable antenna 202 are configured to differ in shape so the first and second radiation patterns 208-210 are different. Depending on the differences in the antennas' shapes, the radiation patterns can also differ in direction, polarization, etc.

As shown, the first reconfigurable antenna 200 has a radiation pattern that is representative of the first geometric shape 400 and the second reconfigurable antenna 202 has a radiation pattern 410 that is representative of the second geometric shape). For example, a spiral or circular shaped antenna will have a circular radiation lobe with a circular polarization while a dipole antenna will have two radiation lobes with a linear polarization.

Figure 5:
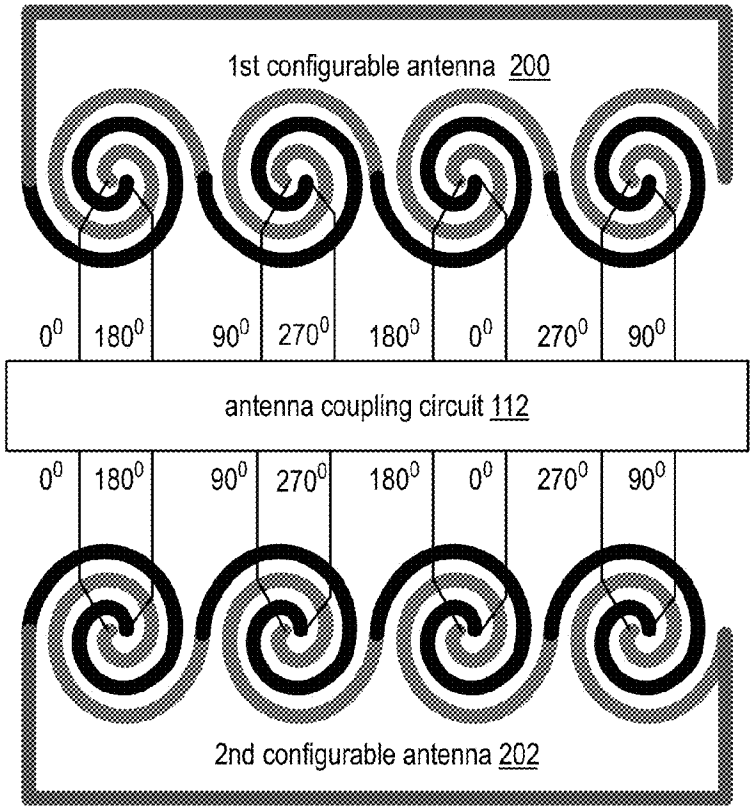
FIG. 5 is a schematic block diagram of another embodiment of a reconfigurable antenna structure in accordance with the present disclosure.

FIG. 5 is a schematic block diagram of another embodiment of a reconfigurable antenna structure that includes a reconfigurable antenna array 110, the configuration module 114, and the antenna processing circuit 112. The reconfigurable antenna array 110 includes first and second reconfigurable antennas 200 and 202. Each of the first and second reconfigurable antennas 200 is configured to have a plurality of spiral antennas. The antenna processing circuit 112 selective couples excitations points of the variable spiral antennas to obtain different radiation patterns as shown in the following figures. The spiral antennas may have a geometric shape of an elliptical interwoven spiral, a triangular-shaped interwoven spiral, a square-shaped interwoven spiral, a rectangular-shaped interwoven spiral, a poly-sided shaped interwoven spiral (e.g., five sides or more), a circular Celtic spiral, an elliptical Celtic spiral, a circular Archimedean spiral shape, an elliptical Archimedean spiral shape, and/or an equiangular interwoven spiral shape.

Figure 6:
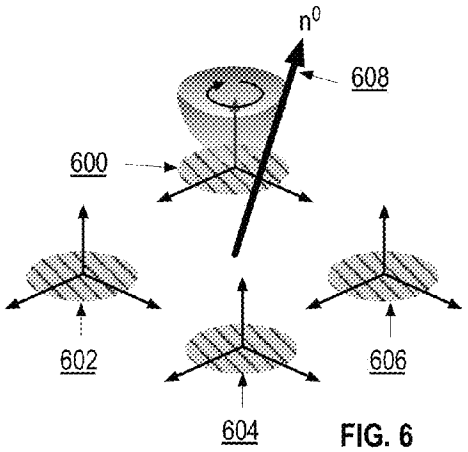
FIG. 6 is a diagram of an example configuration of the reconfigurable antenna structure in accordance with the present disclosure.
Figure 7:
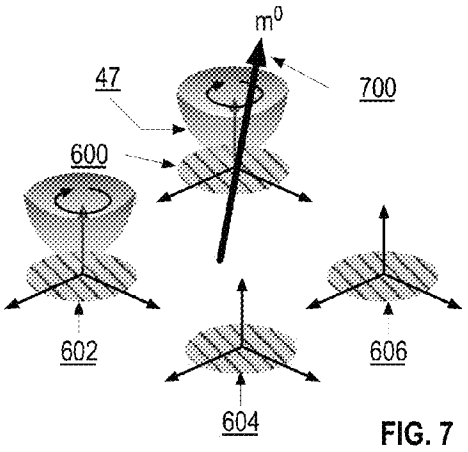
FIG. 7 is a diagram of another example configuration of the reconfigurable antenna structure in accordance with the present disclosure.
Figure 8:
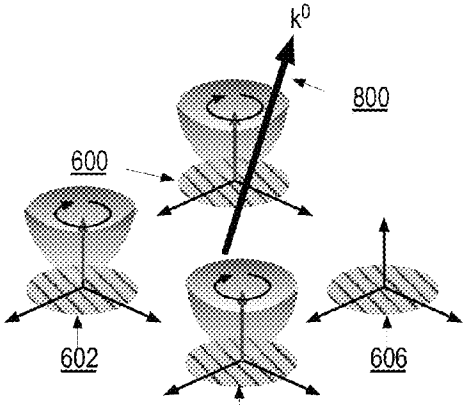
FIG. 8 is a diagram of another example configuration of the reconfigurable antenna structure in accordance with the present disclosure.
Figure 9:
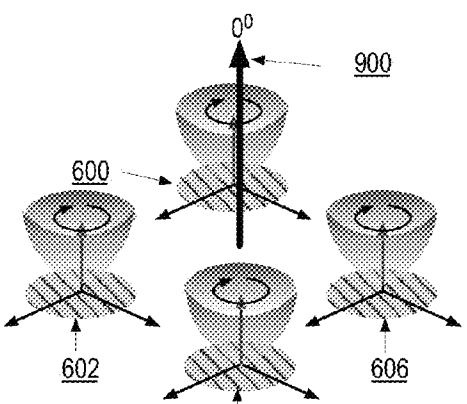
FIG. 9 is a diagram of another example configuration of the reconfigurable antenna structure in accordance with the present disclosure.

FIGS. 6-9 are diagrams of example poly spiral antenna configurations of the first and/or second reconfigurable antenna 200 and/or 202 of the reconfigurable antenna array 110. The first and/or second reconfigurable antenna 200 and/or 202 includes four spiral antenna sections 600-606 as shown in FIG. 5. As shown in FIG. 6, one antenna section 600 of the first or second reconfigurable antenna 200 or 202 is enabled, which yields a beamformed outbound signal having a beamforming angle 608 of 'n' degrees, where n is greater than or equal to two. As shown in FIG. 7, two spiral antenna sections 600 and 602 are enabled, which yields a beamformed RF signal having a beamforming angle 700 of 'm' degrees, where m is less than n. As shown in FIG. 8, three spiral antenna sections 600-604 are enabled, which yields a beamformed RF signal having a beamforming angle 800 of 'k' degrees, where k is less than m. As shown in FIG. 9, four spiral antenna sections 600-606 are enabled, which yields a beamformed RF signal having a beamforming angle 900 of zero degrees.

Figure 10:
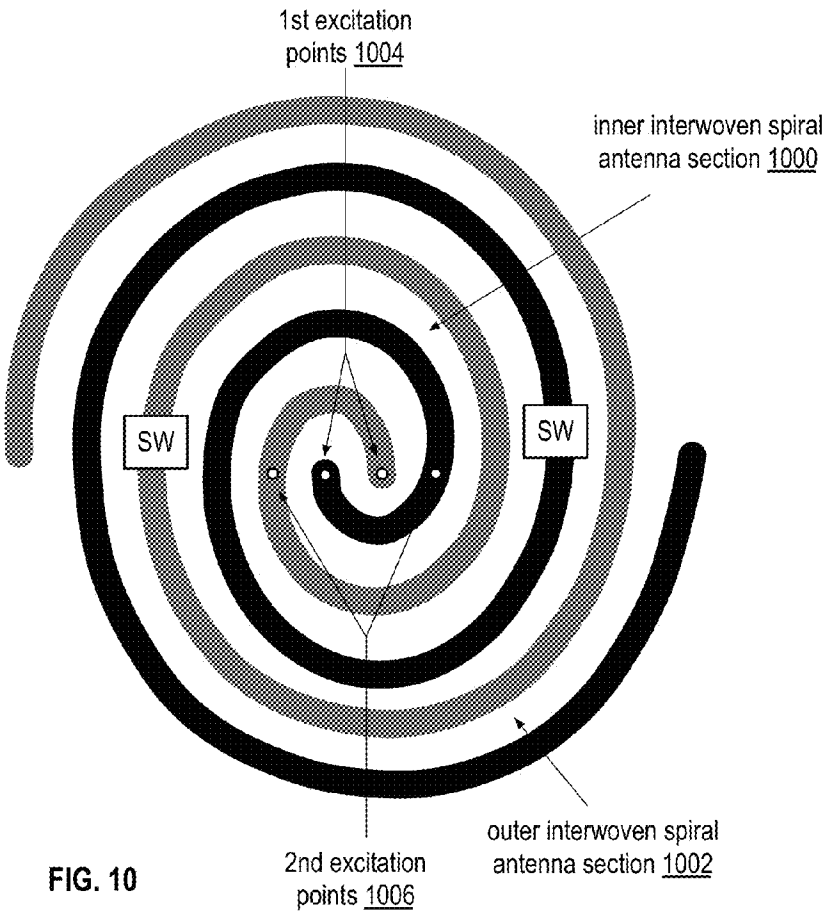
FIG. 10 is a schematic block diagram of an embodiment of a reconfigurable antenna of a reconfigurable antenna structure in accordance with the present disclosure.

FIG. 10 is a schematic block diagram of an embodiment of a reconfigurable antenna of a reconfigurable antenna structure. The antenna includes an inner interwoven spiral antenna section 1000, an outer interwoven spiral antenna section 1002, first excitation points 1004, second excitation points 1006, and switches (SW). The inner interwoven spiral antenna section 1000 includes a first spiral section (e.g., the black trace), a second spiral section (e.g., the gray trace), a first pair of excitation points 1004 at a first spacing and a second pair of excitation points 1006 at a second spacing. The outer interwoven spiral antenna section includes a first spiral section (e.g., the black trace), a second spiral section (e.g., the gray trace).

The inner interwoven spiral antenna section 1000 has a geometric shape of an elliptical interwoven spiral, a triangular-shaped interwoven spiral, a square-shaped interwoven spiral, a rectangular-shaped interwoven spiral, a poly-sided shaped interwoven spiral (e.g., five sides or more), a circular Celtic spiral, an elliptical Celtic spiral, a circular Archimedean spiral shape, an elliptical Archimedean spiral shape, and/or an equiangular interwoven spiral shape. As used herein, an interwoven spiral means a first spiral trace of a spiral shape and a second spiral trace having a complementary or mirrored spiral shape.

The outer interwoven spiral antenna section 1002 has a geometric shape that is a continuation of the geometric shape of the inner interwoven spiral antenna section 1000. For example, when the inner interwoven spiral antenna section 1000 has a circular Celtic spiral shape, the outer interwoven spiral antenna section 1002 has a circular Celtic spiral shape such that, when coupled together, the inner and outer interwoven spiral antenna sections 1000 and 1002 form a larger circular Celtic spiral antenna.

The operating characteristics of the reconfigurable antenna are based on its physical properties. For instance, the reconfigurable antenna's circumference is a factor for a lower frequency cutoff of a frequency band of operation of the antenna. Further, distance of the excitation region (e.g., distance between excitation points and/or radius of an inner most turn) is a factor of an upper frequency cutoff of the frequency band of operation. Still further, the interwoven spiral pattern inverts an opposite radiation lobe of the antenna to approximately double the gain of the spiral antenna. Even further, the number of turns provides different circular polarization radiation patterns. Yet further, the trace width, distance between traces, length of each spiral section, distance to a ground plane, and/or use of an artificial magnetic conductor plane affect the quality factor, radiation pattern, impedance (which is fairly constant over the bandwidth), gain, and/or other characteristics of the reconfigurable antenna.

In a specific example, assume that inner interwoven spiral antenna section 1000 has a 20 mm radius, which equates to a 125.66 mm circumference (e.g., $2*\pi*20=125.66$ mm circumference). Such a circumference corresponds to a low frequency cutoff of approximately 2 GHz. Further assume that the excitation region uses the first excitation points, which has a distance of approximately 5 mm, which establishes a high frequency cutoff of approximately 8 GHz. As such, inner interwoven antenna section 1000 has a bandwidth of 2-8 GHz, centered at 5 GHz.

In another specific example, assume that inner interwoven spiral antenna section 1000 is coupled to the outer interwoven spiral antenna section and collectively have a 60 mm radius, which equates to an approximate circumference of 375 mm. Such a circumference corresponds to a low frequency cutoff of approximately 800 MHz. Further assume that the excitation region uses the second excitation points, which has a distance of approximately 8 mm, which establishes a high frequency cutoff of approximately 5 GHz. As such, inner interwoven antenna section 1000 has a bandwidth of 0.8-5 GHz, centered at 2.5 GHz.

The reconfigurable antenna of FIG. 10 may be used as a stand-alone antenna, in a multi spiral antenna, or in an array of antennas. For example, the reconfigurable antenna may be used as one or more of the plurality of spiral antennas of the first and/or second reconfigurable antennas 200 of FIG. 5. As another example, the reconfigurable antenna may be used for one or more of the first and/or second reconfigurable antennas 200 of FIGS. 2 and/or 4.

Figures 11A, 11B, 11C, 11D:
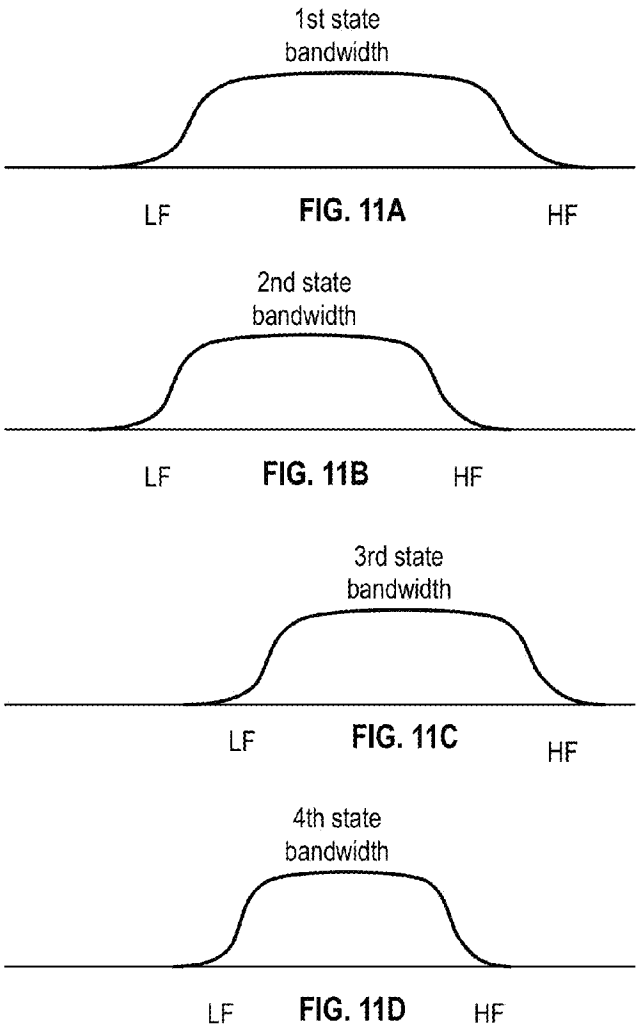
FIGS. 11A-11D are diagrams of examples of variable bandwidths of the reconfigurable antenna of FIG. 10.

The reconfigurable antenna may be configured in a variety of ways. For example, when a configuration signal is in a first state, the first pair of excitation points 1004 are selected and the outer interwoven spiral antenna section 1002 is coupled to the inner interwoven spiral antenna section 1000 to provide a first version of the frequency bandwidth as shown in FIG. 11A. Using the above specific examples, the first pair of excitation points provides a high frequency (HF) cutoff of 8 GHz and the circumference of the outer interwoven spiral antenna section 1002 is coupled to the inner interwoven spiral antenna section 1000 provides a low frequency (LF) cutoff frequency of 800 MHz. As such, the first state bandwidth is 800 MHz to 8 GHz.

When the configuration signal is in a second state, the second pair of excitation points 1006 are selected and the outer interwoven spiral antenna section 1002 is coupled to the inner interwoven spiral antenna section 1000 to provide a second version of the frequency bandwidth as shown in FIG. 11B. Using the above specific examples, the second pair of excitation points provides a high frequency (HF) cutoff of 5 GHz and the circumference of the outer interwoven spiral antenna section 1102 is coupled to the inner interwoven spiral antenna section 1000 provides a low frequency (LF) cutoff frequency of 800 MHz. As such, the second state bandwidth is 800 MHz to 5 GHz.

When the configuration signal is in a third state, the first pair of excitation points 1004 are selected and the outer interwoven spiral antenna section 1002 is not coupled to the inner interwoven spiral antenna section 1000 to provide a third version of the frequency bandwidth as shown in FIG. 11C. Using the above specific examples, the first pair of excitation points provides a high frequency (HF) cutoff of 8 GHz and the circumference of the inner interwoven spiral antenna section 1000 provides a low frequency (LF) cutoff frequency of 2 GHz. As such, the third state bandwidth is 2 GHz to 8 GHz.

When the configuration signal is in a fourth state, the second pair of excitation points 1006 are selected and the outer interwoven spiral antenna section 1002 is not coupled to the inner interwoven spiral antenna section 1000 to provide a fourth version of the frequency bandwidth as shown in FIG. 11D. Using the above specific examples, the second pair of excitation points provides a high frequency (HF) cutoff of 5 GHz and the circumference of the inner interwoven spiral antenna section 1000 provides a low frequency (LF) cutoff frequency of 2 GHz. As such, the fourth state bandwidth is 2 GHz to 5 GHz.

Figure 12:
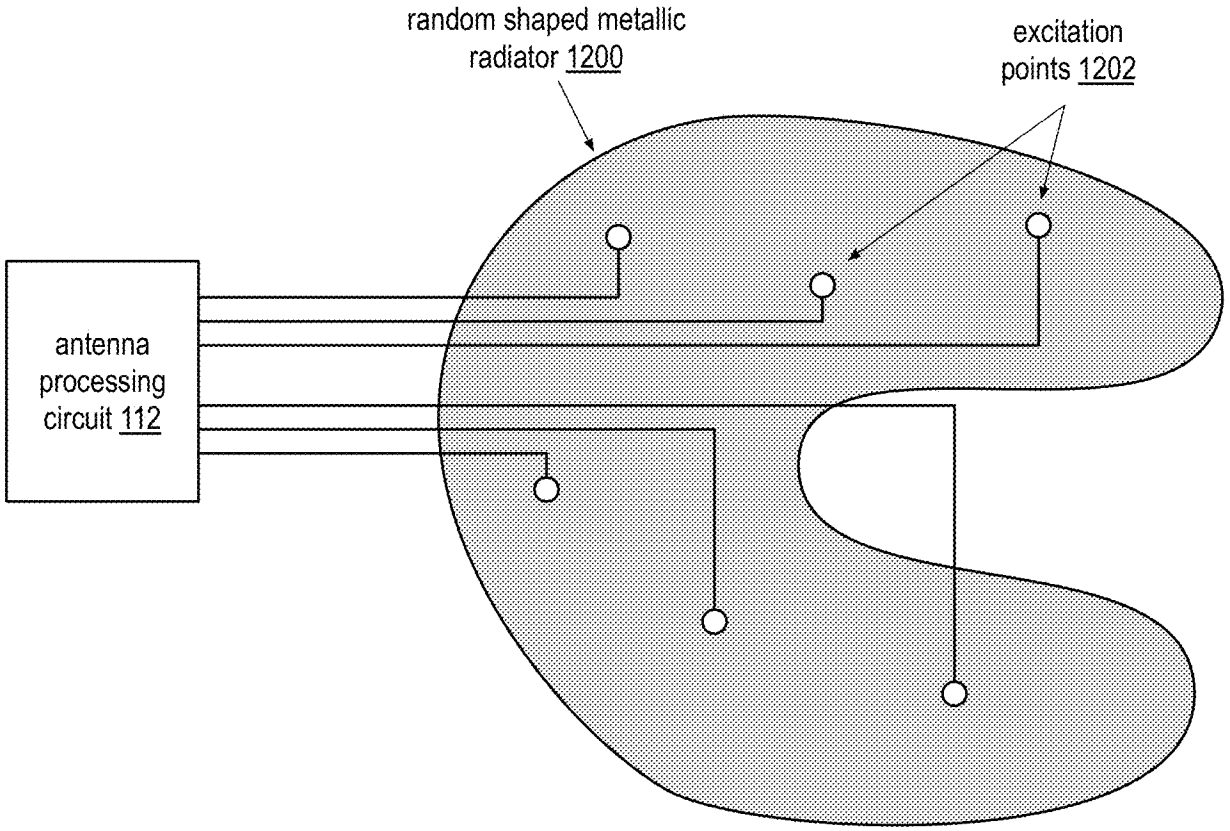
FIG. 12 is a schematic block diagram of another embodiment of a reconfigurable antenna structure in accordance with the present disclosure.

FIG. 12 is a schematic block diagram of another embodiment of a reconfigurable antenna structure that includes the antenna processing circuit 112, a random shaped metallic radiator 1200 and a plurality of excitation points 1202. The random shaped metallic radiator 1200 is on one or more layers of a substrate (e.g., IC die, IC package substrate, a printed circuit board, etc.). The random shaped metallic radiator 1200 has a shape of one of a random circular based shape, a random square based shape, a random triangular based shape, a random meandering trace based shape, a random Polya curve based shape, and a random abstract based shape. The excitation points 1202 are distributed at a variety of distances and at asymmetric locations on the random shaped metallic radiator 1200 based on the shape of the radiator 1200.

The operating characteristics of the reconfigurable antenna are based on its physical properties. For instance, the reconfigurable antenna's shape, area, and circumference are factors for the radiation pattern and/or a lower frequency cutoff of a frequency band of operation of the antenna. Further, distance of the excitation region (e.g., distance between excitation points) is a factor of at least one of a center frequency and an upper frequency cutoff of the frequency band of operation. Still further, the shape and the area of the radiator 1200 and the distance between the selected excitation points affect the quality factor, radiation pattern, impedance (which is fairly constant over the bandwidth), gain, and/or other characteristics of the reconfigurable antenna.

For example, the antenna processing circuit 112 couples, via a transmission line, to one of the excitation points 1202 at a specific location such that the reconfigurable antenna functions similarly to a microstrip antenna. The size and shape of the radiator 1202 with respect to the selected excitation point are factors in the operating characteristics of the antenna. For instance, the length of the radiator with respect to the selected excitation point is a factor in determining the center frequency and the width of the radiator with respect to the selected excitation point is a factor in establishing the impedance of the antenna and its radiation pattern. Thus, by selecting different excitation points, the effective length and width of the antenna are changed, thus changing the center frequency, impedance, and/or radiation pattern.

As another example, the antenna processing circuit 112 couples, via a transmission line, to a pair of the excitation points 1202 at specific locations such that the reconfigurable antenna functions similarly to a loop antenna. The size and shape of the radiator 1202 with respect to the selected excitation point are factors in establishing the radiation pattern of the antenna in establishing the frequency band of operation. The distance between the selected excitation points 1202 is a factor for determining the center frequency and/or a high frequency cutoff of a frequency band of operation. Thus, by selecting different excitation points, the effective length and width of the antenna are changed, the center frequency, frequency band of operation, and/or radiation pattern are changed.

The reconfigurable antenna of FIG. 12 may be used as a stand-alone antenna, in a multi antenna structure, or in an array of antennas. For example, the reconfigurable antenna may be used in place of one or more of the plurality of spiral antennas of the first and/or second reconfigurable antennas 200 of FIG. 5. As another example, the reconfigurable antenna may be used for one or more of the first and/or second reconfigurable antennas 200 of FIGS. 2 and/or 4.

Figure 13:
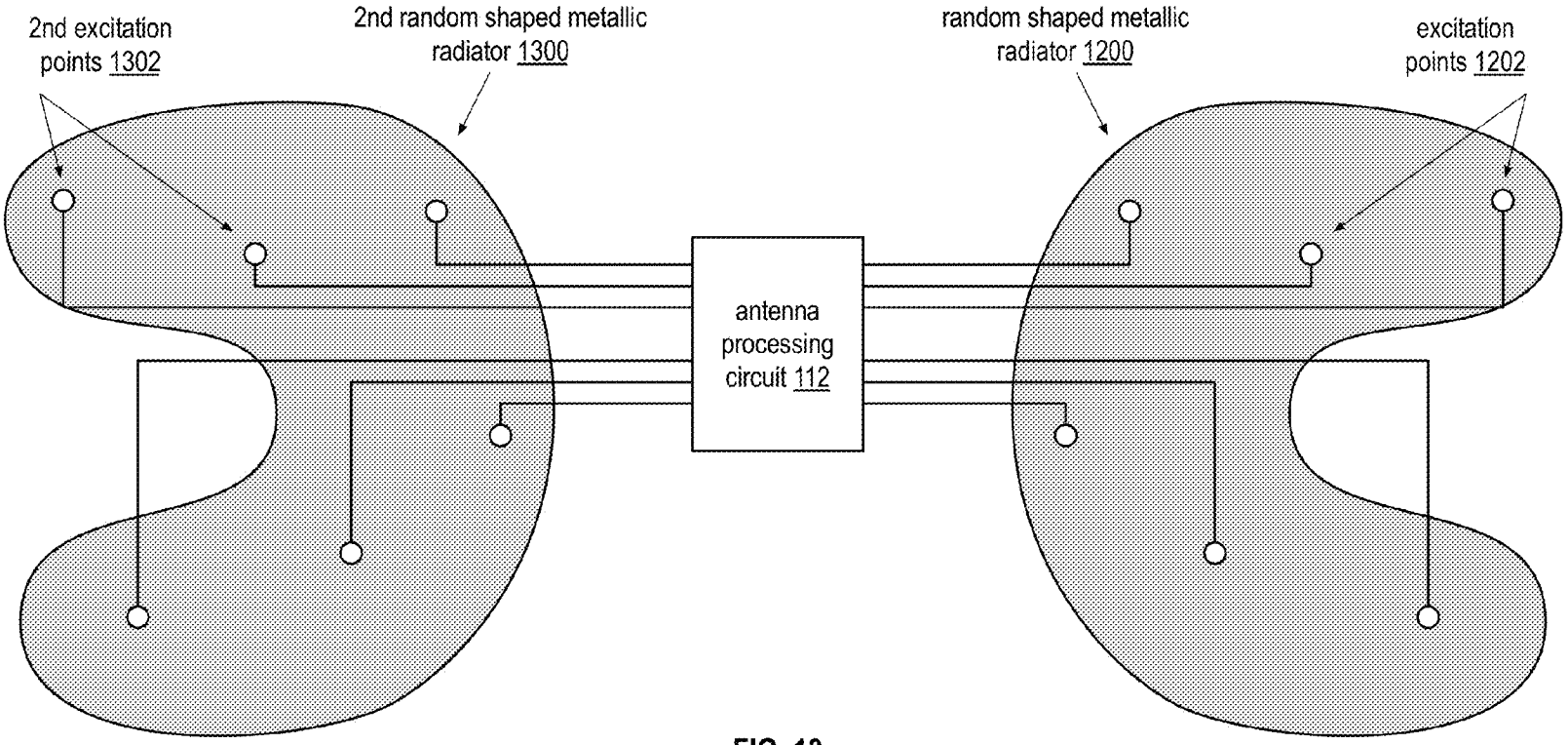
FIG. 13 is a schematic block diagram of another embodiment of a reconfigurable antenna structure in accordance with the present disclosure.

FIG. 13 is a schematic block diagram of another embodiment of a reconfigurable antenna structure that includes a plurality of reconfigurable antennas of FIG. 12 coupled to a common antenna processing circuit 112. For example, the reconfigurable antenna structure includes first and second random shaped metallic radiators 1200 and 1300, which may be of the same shape or different shapes. In addition, the second random shaped metallic radiator 1300 may be on the same layer of a substrate as the first random shaped metallic radiator 1200 or on another layer of the substrate. The second radiator 1300 includes excitation points 1302 that distributed on the second random shaped metallic radiator 1300.

In an example of operation, the antenna processing circuit 112 enables one or more excitation points 1202 and 1302 for each of the radiators 1200 and 1300. For instance, the antenna processing circuit 112 selects an excitation point 1202 such that the first reconfigurable antenna functions similarly to a microstrip antenna and selects a pair of excitation points 1302 such that the second reconfigurable antenna functions similarly to a loop antenna. As such, each reconfigurable antenna may transceive the same inbound and outbound signals or different inbound and outbound signals.

Figure 14:
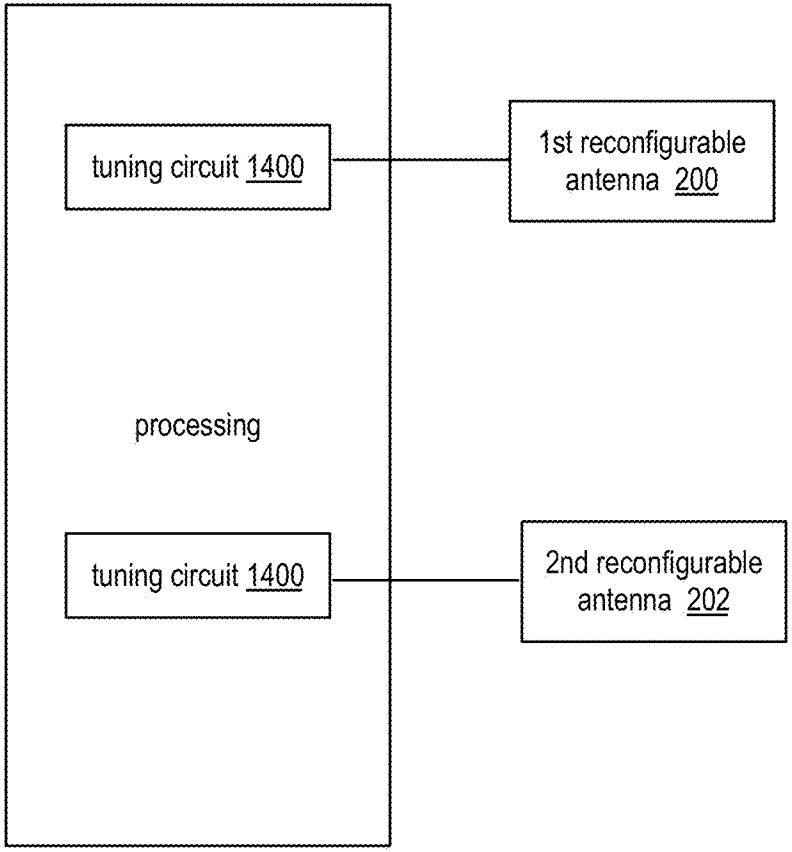
FIG. 14 is a schematic block diagram of an embodiment of an antenna processing circuit in accordance with the present disclosure.

FIG. 14 is a schematic block diagram of an embodiment of an antenna processing circuit 112 coupled to the first and second reconfigurable antennas 200 and 202. The antenna processing circuit 112 includes tuning circuit 1400 coupled to the reconfigurable antennas. Each of the antenna tuning circuit 1400 may include phase shifting circuitry for adjusting the direction of a radiation pattern, impedance matching circuitry, and/or an artificial magnetic conductor to adjust the shape of the radiation pattern.

As may be used herein, the terms "substantially" and "approximately" provides an industry-accepted tolerance for its corresponding term and/or relativity between items. Such an industry-accepted tolerance ranges from less than one percent to fifty percent and corresponds to, but is not limited to, component values, integrated circuit process variations, temperature variations, rise and fall times, and/or thermal noise. Such relativity between items ranges from a difference of a few percent to magnitude differences. As may also be used herein, the term(s) "operably coupled to", "coupled to", and/or "coupling" includes direct coupling between items and/or indirect coupling between items via an intervening item (e.g., an item includes, but is not limited to, a component, an element, a circuit, and/or a module) where, for indirect coupling, the intervening item does not modify the information of a signal but may adjust its current level, voltage level, and/or power level. As may further be used herein, inferred coupling (i.e., where one element is coupled to another element by inference) includes direct and indirect coupling between two items in the same manner as "coupled to". As may even further be used herein, the term "operable to" or "operably coupled to" indicates that an item includes one or more of power connections, input(s), output(s), etc., to perform, when activated, one or more its corresponding functions and may further include inferred coupling to one or more other items. As may still further be used herein, the term "associated with", includes direct and/or indirect coupling of separate items and/or one item being embedded within another item. As may be used herein, the term "compares favorably", indicates that a comparison between two or more items, signals, etc., provides a desired relationship. For example, when the desired relationship is that signal 1 has a greater magnitude than signal 2, a favorable comparison may be achieved when the magnitude of signal 1 is greater than that of signal 2 or when the magnitude of signal 2 is less than that of signal 1.

As may also be used herein, the terms "processing module", "processing circuit", and/or "processing unit" may be a single processing device or a plurality of processing devices. Such a processing device may be a microprocessor, micro-controller, digital signal processor, microcomputer, central processing unit, field programmable gate array, programmable logic device, state machine, logic circuitry, analog circuitry, digital circuitry, and/or any device that manipulates signals (analog and/or digital) based on hard coding of the circuitry and/or operational instructions. The processing module, module, processing circuit, and/or processing unit may be, or further include, memory and/or an integrated memory element, which may be a single memory device, a plurality of memory devices, and/or embedded circuitry of another processing module, module, processing circuit, and/or processing unit. Such a memory device may be a read-only memory, random access memory, volatile memory, non-volatile memory, static memory, dynamic memory, flash memory, cache memory, and/or any device that stores digital information. Note that if the processing module, module, processing circuit, and/or processing unit includes more than one processing device, the processing devices may be centrally located (e.g., directly coupled together via a wired and/or wireless bus structure) or may be distributedly located (e.g., cloud computing via indirect coupling via a local area network and/or a wide area network). Further note that if the processing module, module, processing circuit, and/or processing unit implements one or more of its functions via a state machine, analog circuitry, digital circuitry, and/or logic circuitry, the memory and/or memory element storing the corresponding operational instructions may be embedded within, or external to, the circuitry comprising the state machine, analog circuitry, digital circuitry, and/or logic circuitry. Still further note that, the memory element may store, and the processing module, module, processing circuit, and/or processing unit executes, hard coded and/or operational instructions corresponding to at least some of the steps and/or functions illustrated in one or more of the Figures. Such a memory device or memory element can be included in an article of manufacture.

The present invention has been described above with the aid of method steps illustrating the performance of specified functions and relationships thereof. The boundaries and sequence of these functional building blocks and method steps have been arbitrarily defined herein for convenience of description. Alternate boundaries and sequences can be defined so long as the specified functions and relationships are appropriately performed. Any such alternate boundaries or sequences are thus within the scope and spirit of the claimed invention. Further, the boundaries of these functional building blocks have been arbitrarily defined for convenience of description. Alternate boundaries could be defined as long as the certain significant functions are appropriately performed. Similarly, flow diagram blocks may also have been arbitrarily defined herein to illustrate certain significant functionality. To the extent used, the flow diagram block boundaries and sequence could have been defined otherwise and still perform the certain significant functionality. Such alternate definitions of both functional building blocks and flow diagram blocks and sequences are thus within the scope and spirit of the claimed invention. One of average skill in the art will also recognize that the functional building blocks, and other illustrative blocks, modules and components herein, can be implemented as illustrated or by discrete components, application specific integrated circuits, processors executing appropriate software and the like or any combination thereof.

The present invention may have also been described, at least in part, in terms of one or more embodiments. An embodiment of the present invention is used herein to illustrate the present invention, an aspect thereof, a feature thereof, a concept thereof, and/or an example thereof. A physical embodiment of an apparatus, an article of manufacture, a machine, and/or of a process that embodies the present invention may include one or more of the aspects, features, concepts, examples, etc. described with reference to one or more of the embodiments discussed herein. Further, from figure to figure, the embodiments may incorporate the same or similarly named functions, steps, modules, etc. that may use the same or different reference numbers and, as such, the functions, steps, modules, etc. may be the same or similar functions, steps, modules, etc. or different ones.

Unless specifically stated to the contra, signals to, from, and/or between elements in a figure of any of the figures presented herein may be analog or digital, continuous time or discrete time, and single-ended or differential. For instance, if a signal path is shown as a single-ended path, it also represents a differential signal path. Similarly, if a signal path is shown as a differential path, it also represents a single-ended signal path. While one or more particular architectures are described herein, other architectures can likewise be implemented that use one or more data buses not expressly shown, direct connectivity between elements, and/or indirect coupling between other elements as recognized by one of average skill in the art.

The term "module" is used in the description of the various embodiments of the present invention. A module includes a processing module, a functional block, hardware, and/or software stored on memory for performing one or more functions as may be described herein. Note that, if the module is implemented via hardware, the hardware may operate independently and/or in conjunction software and/or firmware. As used herein, a module may contain one or more sub-modules, each of which may be one or more modules.

While particular combinations of various functions and features of the present invention have been expressly described herein, other combinations of these features and functions are likewise possible. The present invention is not limited by the particular examples disclosed herein and expressly incorporates these other combinations.

What is claimed is:

1. A reconfigurable antenna structure comprising:

a first reconfigurable antenna configured, in response to a first configuration signal, to have a first radiation pattern and to have a first frequency bandwidth, wherein the first reconfigurable antenna includes a first plurality of interwoven spiral antenna sections, each of the plurality of interwoven spiral antenna sections includes excitation points, the first configuration signal enables the excitation points of one or more of the plurality of interwoven spiral antenna sections to produce the first radiation pattern, and spacing of the excitation points and circumference of the one or more of the plurality of interwoven spiral antenna sections establishes the first frequency bandwidth;

a second reconfigurable antenna configured, in response to a second configuration signal, to have a second radiation pattern and to have a second frequency bandwidth, wherein the first and second frequency bandwidths at least partially overlap and wherein channels of interest are within the at least partially overlapping first and second frequency bandwidths, wherein the second reconfigurable antenna includes a second plurality of interwoven spiral antenna sections, each of the second plurality of interwoven spiral antenna sections includes excitation points, the second configuration signal enables the excitations points of one or more of the second plurality of interwoven spiral antenna sections to produce the second radiation pattern, and spacing of the excitation points and circumference of the one or more of the second plurality of interwoven spiral antenna sections establishes the second frequency bandwidth;

a configuration module configured to generate the first and second configuration signals; and an antenna processing circuit configured to:

send one or more transmit signals to one or more of the first and second reconfigurable antennas for transmission via one or more of the channels of interest; and receive one or more receive signals from the one or more of the first and second reconfigurable antennas.

2. The reconfigurable antenna structure of claim 1, wherein:

the first reconfigurable antenna is further configured, in response to the first configuration signal, to have a first geometric shape to provide the first radiation pattern and the first frequency bandwidth; and the second reconfigurable antenna is further configured, in response to the second configuration signal, to have a second geometric shape to provide the second radiation pattern and the second frequency bandwidth, wherein each of the first and second geometric shapes comprising one of: a line, a polygon, a circle, an ellipse, a hyperbola, a parabola, a spiral, and an eccentric spiral.

3. The reconfigurable antenna structure of claim 1, wherein the first reconfigurable antenna further comprises one or more high frequency switches, wherein, when the first configuration signal is in:

a first state, the first pair of excitation points are selected and the one or more high frequency switches are enabled to couple the outer interwoven spiral antenna section to the inner interwoven spiral antenna section to provide a first version of the first frequency bandwidth;

a second state, the second pair of excitation points are selected and the one or more high frequency switches are enabled to couple the outer interwoven spiral antenna section to the inner interwoven spiral antenna section to provide a second version of the first frequency bandwidth;

a third state, the first pair of excitation points are selected and the one or more high frequency switches are disabled such that the outer interwoven spiral antenna section is not coupled to the inner interwoven spiral antenna section to provide a third version of the first frequency bandwidth; and a fourth state, the second pair of excitation points are selected and the one or more high frequency switches are disabled such that the outer interwoven spiral antenna section is not coupled to the inner interwoven spiral antenna section to provide a fourth version of the first frequency bandwidth.

4. The reconfigurable antenna structure of claim 1, wherein:

each of the first plurality of interwoven spiral antenna sections includes:

an inner interwoven spiral antenna section having a first pair of excitation points at a first spacing and a second pair of excitation points at a second spacing;

an outer interwoven spiral antenna section; and one or more high frequency switches that, when enabled, couples the outer interwoven spiral antenna section to the inner interwoven spiral antenna section; and the first configuration signal indicates:

enablement of one or more of the plurality of reconfigurable interwoven spiral antenna sections; and for each of the one or more of the plurality of reconfigurable interwoven spiral antenna sections that are enabled, whether the one or more high frequency switches are enable and whether the first or the second pair of excitation points are to be used.

5. The reconfigurable antenna structure of claim 1, wherein the first reconfigurable antenna further comprising:

a random shaped metal radiator; and a plurality of excitation points distributed on the random shaped metal element, wherein the first configuration signal selects a pair of excitation points from the plurality of excitation points.

6. The reconfigurable antenna structure of claim 1 further comprising:

a third reconfigurable antenna configured, in response to a third configuration signal, to have a third radiation pattern and to have a third frequency bandwidth;

a fourth reconfigurable antenna configured, in response to a fourth configuration signal, to have a fourth radiation pattern and to have a fourth frequency bandwidth, wherein the third and fourth frequency bandwidths at least partially overlap and wherein second channels of interest are within the at least partially overlapping third and fourth frequency bandwidths;

the configuration module is further configured to generate the third and fourth configuration signals; and the antenna processing circuit is further configured to:

send one or more transmit signals to one or more of the first and second reconfigurable antennas for transmission via one or more of the channels of interest; and receive one or more receive signals from the one or more of the first and second reconfigurable antennas.

7. The reconfigurable antenna structure of claim 1, wherein the antenna processing circuit further comprising:

a first antenna tuning circuit operable to adjust at least one of:

shape of the first radiation pattern;

direction of the first radiation pattern; and a second antenna tuning circuit operable to adjust at least one of:

shape of the second radiation pattern; and direction of the second radiation pattern.

8. The reconfigurable antenna structure of claim 1, wherein the antenna processing circuit further comprising at least one of:

coupling for multiple input multiple output (MIMO) operation;

coupling for diversity antenna operation; and coupling for diversity antenna MIMO operation.

9. A radio frequency (RF) front-end circuit comprising:

a plurality of power amplifiers;

a plurality of low noise amplifiers;

a reconfigurable antenna structure configured, in response to a configuration signal, to have a radiation pattern and to have a frequency bandwidth, the reconfigurable antenna structure comprising:

an inner interwoven spiral antenna section having a first pair of excitation points at a first spacing and a second pair of excitation points at a second spacing;

an outer interwoven spiral antenna section; and one or more high frequency switches, wherein, when the first configuration signal is in:

a first state, the first pair of excitation points are selected and the one or more high frequency switches are enabled to couple the outer interwoven spiral antenna section to the inner interwoven spiral antenna section to provide a first version of the first frequency bandwidth;

a second state, the second pair of excitation points are selected and the one or more high frequency switches are enabled to couple the outer interwoven spiral antenna section to the inner interwoven spiral antenna section to provide a second version of the first frequency bandwidth;

a third state, the first pair of excitation points are selected and the one or more high frequency switches are disabled such that the outer interwoven spiral antenna section is not coupled to the inner interwoven spiral antenna section to provide a third version of the first frequency bandwidth; and a fourth state, the second pair of excitation points are selected and the one or more high frequency switches are disabled such that the outer interwoven spiral antenna section is not coupled to the inner interwoven spiral antenna section to provide a fourth version of the first frequency bandwidth;

a configuration module operable to generate the configuration signal; and an antenna processing circuit operable to:

receive one or more transmit signals from one or more of the plurality of power amplifiers;

send the one or more transmit signals to the reconfigurable antenna structure for transmission via one or more channels of interest;

receive one or more receive signals from the reconfigurable antenna structure; and send the one or more receive signals to one or more of the plurality of low noise amplifiers.

10. The RF front end circuit of claim 9, wherein the reconfigurable antenna structure including:

a first reconfigurable antenna configured, in response to a first configuration signal, to have a first radiation pattern and to have a first frequency bandwidth;

a second reconfigurable antenna configured, in response to a second configuration signal, to have a second radiation pattern and to have a second frequency bandwidth, wherein the first and second frequency bandwidths at least partially overlap and wherein channels of interest are within the at least partially overlapping first and second frequency bandwidths; and the configuration module operable to generate the first and second configuration signals.

11. The RF front end circuit of claim 10 further comprising:

the first reconfigurable antenna is further configured, in response to the first configuration signal, to have a first geometric shape to provide the first radiation pattern and the first frequency bandwidth; and the second reconfigurable antenna is further configured, in response to the second configuration signal, to have a second geometric shape to provide the second radiation pattern and the second frequency bandwidth, wherein each of the first and second geometric shapes comprising one of: a line, a polygon, a circle, an ellipse, a hyperbola, a parabola, a spiral, and an eccentric spiral.

12. The RF front end circuit of claim 10, wherein the first reconfigurable antenna comprising:

a plurality of reconfigurable interwoven spiral antenna sections, wherein each of the plurality of interwoven spiral antenna sections includes:

an inner interwoven spiral antenna section having a first pair of excitation points at a first spacing and a second pair of excitation points at a second spacing;

an outer interwoven spiral antenna section; and one or more high frequency switches that, when enabled, couples the outer interwoven spiral antenna section to the inner interwoven spiral antenna section;

wherein the first configuration signal indicates:

enablement of one or more of the plurality of reconfigurable interwoven spiral antenna sections; and for each of the one or more of the plurality of reconfigurable interwoven spiral antenna sections that are enabled, whether the one or more high frequency switches are enable and whether the first or the second pair of excitation points are to be used.

13. The RF front end circuit of claim 9 further comprising:

the reconfigurable antenna structure including:

a random shaped metallic radiator on a layer of a substrate;

a plurality of excitation points distributed on the random shaped metallic radiator; and the antenna processing circuit operable to enable two or more of the plurality of excitation points based on the configuration signal.

14. A reconfigurable antenna structure comprising:

a first reconfigurable antenna configured, in response to a first configuration signal, to have a first radiation pattern and to have a first frequency bandwidth, the first reconfigurable antenna comprising:

a plurality of reconfigurable interwoven spiral antenna sections, wherein each of the plurality of interwoven spiral antenna sections includes:

an inner interwoven spiral antenna section having a first pair of excitation points at a first spacing and a second pair of excitation points at a second spacing;

an outer interwoven spiral antenna section; and one or more high frequency switches that, when enabled, couples the outer interwoven spiral antenna section to the inner interwoven spiral antenna section;

wherein the first configuration signal indicates:

enablement of one or more of the plurality of reconfigurable interwoven spiral antenna sections; and for each of the one or more of the plurality of reconfigurable interwoven spiral antenna sections that are enabled, whether the one or more high frequency switches are enable and whether the first or the second pair of excitation points are to be used;

a second reconfigurable antenna configured, in response to a second configuration signal, to have a second radiation pattern and to have a second frequency bandwidth, wherein the first and second frequency bandwidths at least partially overlap and wherein channels of interest are within the at least partially overlapping first and second frequency bandwidths;

a configuration module configured to generate the first and second configuration signals; and an antenna processing circuit configured to:

send one or more transmit signals to one or more of the first and second reconfigurable antennas for transmission via one or more of the channels of interest; and receive one or more receive signals from the one or more of the first and second reconfigurable antennas.

15. The reconfigurable antenna structure of claim 14 wherein:

the first reconfigurable antenna is further configured, in response to the first configuration signal, to have a first geometric shape to provide the first radiation pattern and the first frequency bandwidth; and the second reconfigurable antenna is further configured, in response to the second configuration signal, to have a second geometric shape to provide the second radiation pattern and the second frequency bandwidth, wherein each of the first and second geometric shapes comprising one of: a line, a polygon, a circle, an ellipse, a hyperbola, a parabola, a spiral, and an eccentric spiral.

16. The reconfigurable antenna structure of claim 14, wherein:

the first configuration signal enables the excitations points of one or more of the plurality of interwoven spiral antenna sections of the first reconfigurable antenna to produce the first radiation pattern; and the second configuration signal enables the excitations points of one or more of the second plurality of interwoven spiral antenna sections of the second reconfigurable antenna to produce the second radiation pattern.

17. The reconfigurable antenna structure of claim 14, wherein the first reconfigurable antenna further comprises:

a random shaped metal radiator; and a plurality of excitation points distributed on the random shaped metal element, wherein the first configuration signal selects a pair of excitation points from the plurality of excitation points.

18. The reconfigurable antenna structure of claim 14, further comprises:

a third reconfigurable antenna configured, in response to a third configuration signal, to have a third radiation pattern and to have a third frequency bandwidth;

a fourth reconfigurable antenna configured, in response to a fourth configuration signal, to have a fourth radiation pattern and to have a fourth frequency bandwidth, wherein the third and fourth frequency bandwidths at least partially overlap and wherein second channels of interest are within the at least partially overlapping third and fourth frequency bandwidths;

the configuration module is further configured to generate the third and fourth configuration signals; and the antenna processing circuit is further configured to:

send one or more transmit signals to one or more of the first and second reconfigurable antennas for transmission via one or more of the channels of interest; and receive one or more receive signals from the one or more of the first and second reconfigurable antennas.

19. The reconfigurable antenna structure of claim 14, wherein the antenna processing circuit further comprising:

a first antenna tuning circuit operable to adjust at least one of:

shape of the first radiation pattern;

direction of the first radiation pattern; and a second antenna tuning circuit operable to adjust at least one of:

shape of the second radiation pattern; and direction of the second radiation pattern.

20. The reconfigurable antenna structure of claim 14, wherein the antenna processing circuit further comprising at least one of:

coupling for multiple input multiple output (MIMO) operation;

coupling for diversity antenna operation; and coupling for diversity antenna MIMO operation.

* * * * *